US007631379B2

(12) United States Patent
Lindner

(10) Patent No.: US 7,631,379 B2
(45) Date of Patent: Dec. 15, 2009

(54) HIGH/LOW BED AND LEG ASSEMBLY FOR RAISING AND LOWERING THE HIGH/LOW BED

(75) Inventor: Perry Lindner, Custer, WI (US)

(73) Assignee: Joerns Healthcare Inc., Stevens Point, WI (US)

( * ) Notice: Subject to any disclaimer, the term of this patent is extended or adjusted under 35 U.S.C. 154(b) by 290 days.

(21) Appl. No.: 11/544,536

(22) Filed: Oct. 9, 2006

(65) Prior Publication Data

US 2007/0083993 A1 Apr. 19, 2007

(51) Int. Cl.
*A61G 7/012* (2006.01)
*A61G 1/02* (2006.01)

(52) U.S. Cl. ..... 5/611; 5/86.1; 296/20

(58) Field of Classification Search ..... 5/611, 5/11, 610, 620, 600, 86.1; 296/20; 16/35 R
See application file for complete search history.

(56) References Cited

U.S. PATENT DOCUMENTS

| | | | | | |
|---|---|---|---|---|---|
| 2,345,442 | A * | 3/1944 | Winter et al. | ..... | 16/35 R |
| 2,841,438 | A * | 7/1958 | Weil | ..... | 296/20 |
| 2,877,048 | A * | 3/1959 | Weil | ..... | 296/20 |
| 3,088,770 | A * | 5/1963 | Ferneau et al. | ..... | 296/20 |
| 3,223,429 | A * | 12/1965 | Hastings | ..... | 280/641 |
| 3,493,262 | A * | 2/1970 | Ferneau | ..... | 296/20 |
| 3,498,628 | A * | 3/1970 | Ferneau et al. | ..... | 280/641 |
| 3,637,232 | A * | 1/1972 | Bourgraf et al. | ..... | 280/641 |
| 4,097,939 | A * | 7/1978 | Peck et al. | ..... | 5/611 |
| 4,192,541 | A * | 3/1980 | Ferneau | ..... | 296/20 |
| 4,685,160 | A * | 8/1987 | Rizzardo | ..... | 5/620 |
| 4,921,295 | A * | 5/1990 | Stollenwerk | ..... | 296/20 |
| 5,095,562 | A * | 3/1992 | Alexander | ..... | 5/616 |
| 5,257,428 | A * | 11/1993 | Carroll et al. | ..... | 5/620 |
| 5,347,682 | A * | 9/1994 | Edgerton, Jr. | ..... | 16/34 |
| 5,432,966 | A * | 7/1995 | Berta et al. | ..... | 5/611 |
| 5,438,723 | A * | 8/1995 | Carroll | ..... | 5/620 |
| 5,669,090 | A * | 9/1997 | Basgall | ..... | 5/620 |
| 5,878,452 | A * | 3/1999 | Brooke et al. | ..... | 5/428 |
| 6,161,236 | A * | 12/2000 | Carroll | ..... | 5/618 |
| 6,185,767 | B1 * | 2/2001 | Brooke et al. | ..... | 5/600 |
| 6,230,344 | B1 * | 5/2001 | Thompson et al. | ..... | 5/611 |
| 6,240,583 | B1 * | 6/2001 | Brooke et al. | ..... | 5/662 |
| 6,357,065 | B1 * | 3/2002 | Adams | ..... | 5/618 |
| 6,397,416 | B2 * | 6/2002 | Brooke et al. | ..... | 5/662 |
| 6,473,921 | B2 * | 11/2002 | Brooke et al. | ..... | 5/600 |
| 6,473,922 | B1 * | 11/2002 | Sommerfeld et al. | ..... | 5/610 |
| 6,516,479 | B1 * | 2/2003 | Barbour | ..... | 5/618 |
| 6,578,216 | B1 * | 6/2003 | Aarestad | ..... | 5/618 |
| 6,829,793 | B2 * | 12/2004 | Brooke et al. | ..... | 5/425 |
| 6,880,202 | B2 * | 4/2005 | Thompson et al. | ..... | 16/35 R |
| 7,013,510 | B1 * | 3/2006 | Johnson | ..... | 5/611 |
| 7,334,277 | B2 * | 2/2008 | Johnson | ..... | 5/611 |
| 7,490,884 | B2 * | 2/2009 | Matunaga et al. | ..... | 296/20 |
| 2004/0111798 | A1 * | 6/2004 | Matunaga et al. | ..... | 5/86.1 |
| 2006/0225203 | A1 * | 10/2006 | Hosoya et al. | ..... | 5/86.1 |
| 2007/0083992 | A1 * | 4/2007 | Lindner et al. | ..... | 5/611 |
| 2007/0083993 | A1 * | 4/2007 | Lindner | ..... | 5/611 |

* cited by examiner

*Primary Examiner*—Robert G Santos
(74) *Attorney, Agent, or Firm*—MacMillan, Sobanski & Todd, LLC

(57) ABSTRACT

A bed comprises a main frame, a leg comprising at least one leg member and at least one link, and a stabilizer connecting the leg member to the main frame. At least portions of the main frame, the leg, the link, and the stabilizer form a four bar system for raising and lowering the bed.

11 Claims, 7 Drawing Sheets

HIGH/LOW BED AND LEG ASSEMBLY FOR RAISING AND LOWERING THE HIGH/LOW BED

BACKGROUND OF THE INVENTION

This invention relates in general to beds and in particular, to high/low beds, which are beds that are adapted to be raised and lowered relative to a supporting support, such as a floor. Most particularly, the invention relates to a linkage assembly for high/low beds.

High/low beds are well known. A conventional high/low bed includes a sleep surface supported by a main frame. The main frame is supported by a pair of opposing legs (i.e., legs at opposite ends of the main frame). The sleep surface often includes a head section, a foot section, and a knee section between the head and foot sections. The head and knee sections are pivotally supported by a main frame so that they may be raised and lowered relative to the main frame. The foot section is pivotally connected to the knee section so that it moves in response to movement of the knee section. In addition to the sleep surface being movable, the legs of the bed are movable. Movement of the legs changes the position of the main frame relative to a supporting surface (i.e., a floor or the ground) by raising or lowering the main frame.

The physical structure of the high/low bed often limits its ability to achieve desired minimum and maximum elevations. For example, forces acting upon the legs are greatest when the bed first begins to rise from its lowest position. These forces resist movement of the legs if the angular disposition of the legs is too great. As the legs come closer to being horizontal, when the bed is in its lowered position, a greater amount of force is required to start the legs in motion to raise the bed. The force can become so great that a cost-effective mechanical means for displacing the legs could be ineffective.

What is needed is a high/low bed having an elevation that is minimized when in a lowered position and that has a cost-effective mechanical means for raising the bed from its lowered position.

SUMMARY OF THE INVENTION

The present invention is directed towards a bed that meets the foregoing needs. The bed comprises a main frame, a leg comprising at least one leg member and at least one link, and a stabilizer connecting the leg member to the main frame. At least portions of the main frame, the leg, the link, and the stabilizer form a four bar system for raising and lowering the bed.

DETAILED DESCRIPTION

Figure 1:
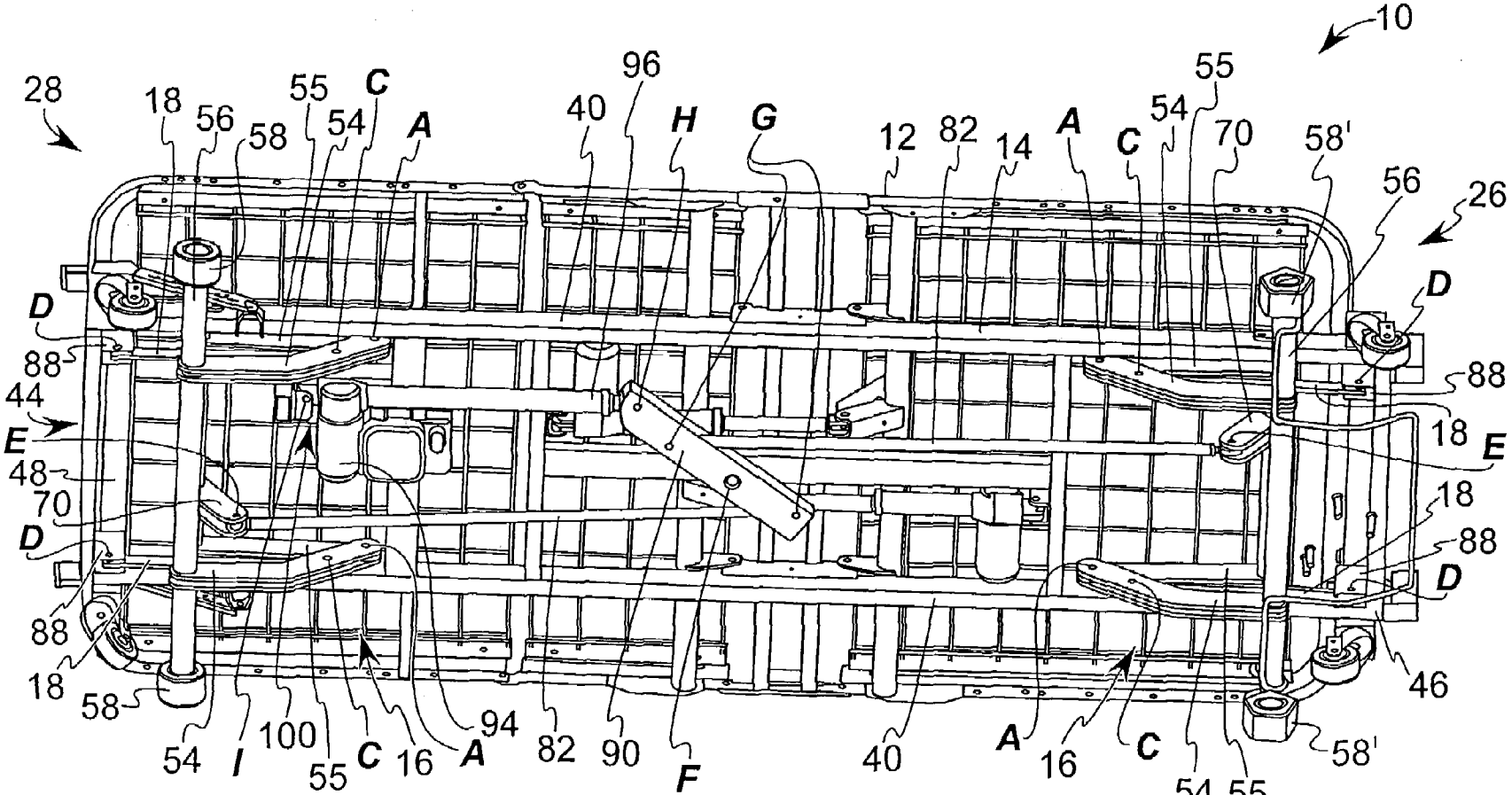
FIG. 1 is a bottom perspective view of a high/low bed in a lowered position.

There is illustrated in FIGS. 1-4 a bed 10 comprising a sleep surface 12 supported by a main frame 14. The main frame 14 is supported by a pair of opposing legs 16 and corresponding stabilizers 18 (i.e., legs and stabilizers at opposite ends of the main frame 14). The legs 16 and the stabilizers 18 are located primarily below the main frame 14 to provide subjacent support for the main frame 14. As will become more apparent in the description that follows, the legs 16 and the stabilizers 18 are operatively attached to the main frame 14 and one another so as to be movable relative to the main frame 14 and one another. The legs 16 and the stabilizers 18 are movable to permit the elevation of the main frame 14 to be varied relative to a supporting surface. The entire main frame 14 may be lowered or raised relative to the supporting surface by raising and lowering the head and foot ends 26, 28 of the main frame 14.

Figure 2:
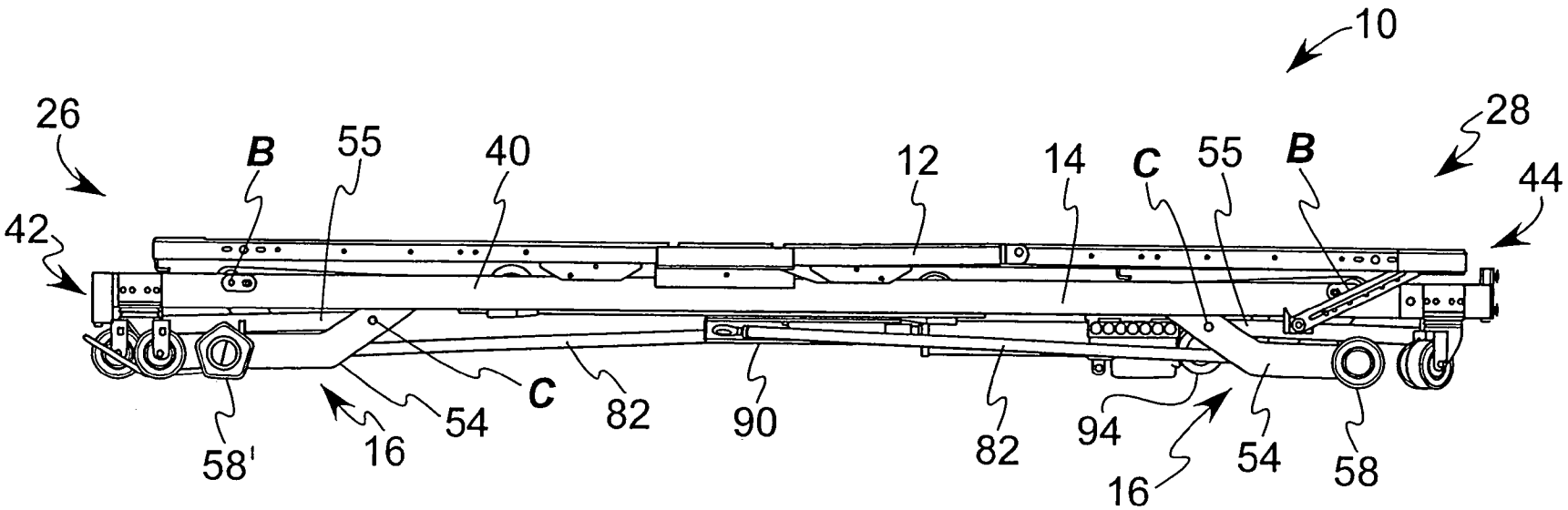
FIG. 2 is a side elevational view of the high/low bed shown in FIG. 1.
Figure 3:
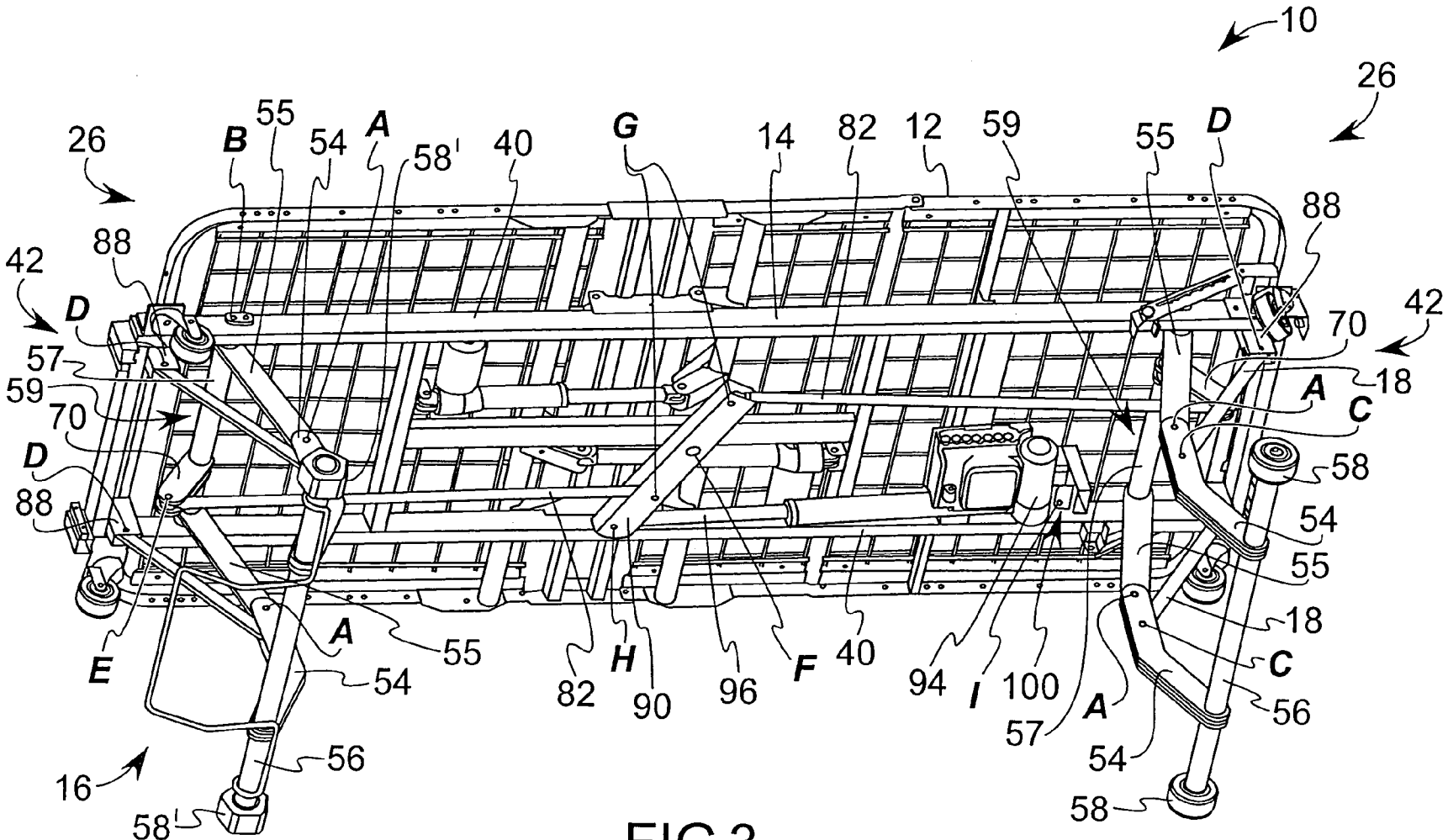
FIG. 3 is a bottom perspective view of the high/low bed shown in FIG. 1 in a raised position.
Figure 4:
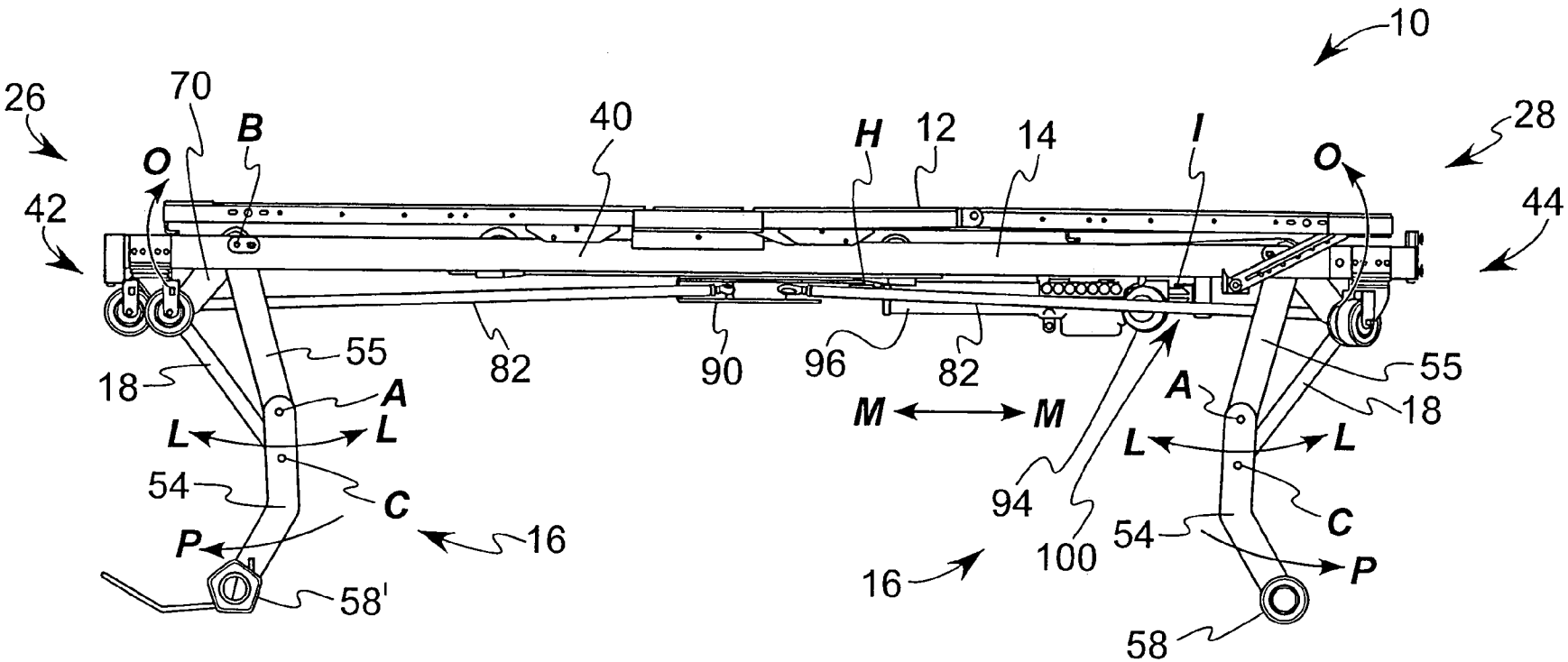
FIG. 4 is a side elevational view of the high/low bed shown in FIG. 3.
Figure 10:
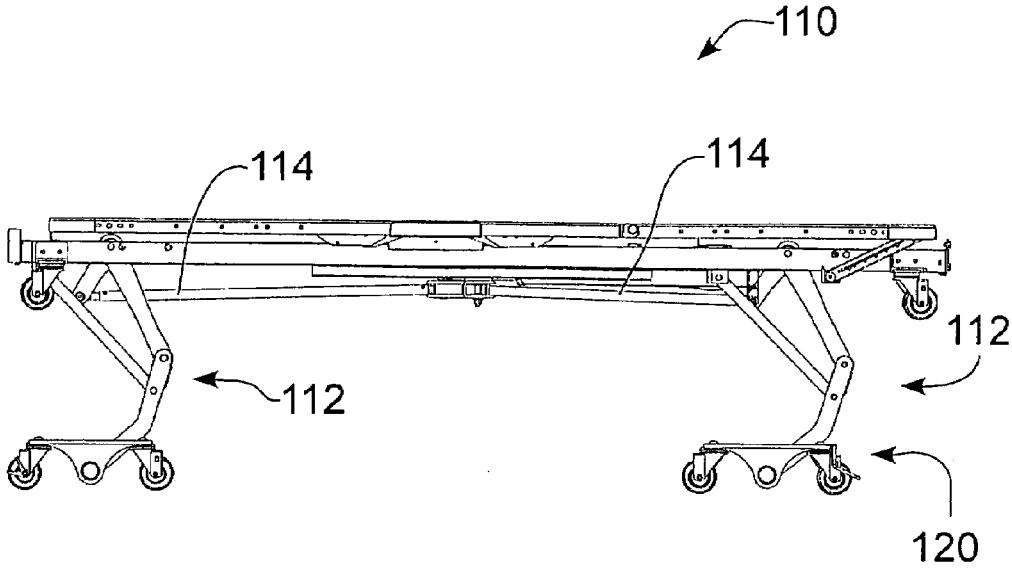
FIG. 10 is a side elevational view of another high/low bed.

The main frame 14 includes opposing side rails 40 that extend in a longitudinal direction from a head end 42 and a foot end 44 and are joined together by head and foot rails 46, 48 (shown in FIG. 1). The legs 16 preferably include upper bent leg members 54 and a lower laterally extending foot member 56 (shown in FIGS. 1 and 3). The leg member 54 includes an upper portion and a lower portion, separated by the bend. The bend in the leg members 54 is in the longitudinal direction. The bend in the leg members 54 is preferred to limit longitudinal travel (i.e., travel in left or right directions when viewing the drawings) of the lower laterally extending foot member 56 and thus limit travel of the bed 10. As can be seen in reference to FIGS. 2 and 4, the spacing between the foot members 56 at the head end 42 and foot end 44 of the main frame 14 when the bed 10 is in a lowered position (as shown in FIG. 2), is substantially the same as the spacing when the bed 10 is in a raised position (as shown in FIG. 4). Further, the longitudinal position of the foot members 56 relative to the main frame 14 when the bed 10 is in the lowered position is substantially the same as the longitudinal position of the foot members 56 relative to the main frame 14 when the bed 10 is in the raised position. The lateral extent of the foot members 56 may exceed the bent leg members 54 for attachment of wheels, such as the conventional shaped wheels 58 and the pentagonal shaped wheels 58' shown. It should be note that the pentagonal shaped wheels 58' have a flat surface for resisting movement of the bed 10 on the supporting surface. Alternatively, the bed 10 may be provided with a wheel and brake assembly 120 comprising one or more conventional wheels the movement of which is resisted or prevented by a brake that is activated by a brake lever, as shown in FIG. 10.

The stabilizers 18 are connected between the bent leg members 56 and the main frame 14. According to the preferred embodiment of the invention, the stabilizers 18 are connected to brackets 88 mounted to the head and foot rails 46, 48 of the main frame 14.

An upper portion of each bent leg member 54 is pivotally displaceable relative to a lower portion of a link 55 at a first orbital pivot point, designated at A. A laterally extending member 57, as shown in FIG. 3, extends between upper portions of opposing laterally spaced links 55. The laterally spaced links 55 and the laterally extending member 57 form a link assembly, generally indicated at 59. The laterally extending member 57 is pivotally displaceable relative to the side rails 40 of the main frame 14 at a first fixed pivot point, designated at B. A lower intermediate portion of each bent leg member 54 is pivotally connected to a lower portion of a corresponding stabilizer 18 at a second orbital pivot point designated at C. An upper portion of each stabilizer 18, in turn, is pivotally connected to a corresponding stabilizer bracket 88 at a second fixed pivot point, designated at D. It should be noted that the two orbital pivot points A, C and the two fixed pivot points B, D outline a four bar system. The fixed pivot points B, D are preferably at different elevations so as to deviate from a traditional parallelogram. A parallel relationship between the stabilizer 18 and the link 55 may result in a loss in mechanical advantage. Consequently, a non-parallel relationship is preferred. There may be other arrangements that may establish a desired mechanical advantage but in contemplating other arrangements, translation (i.e., longitudinal travel of the lower laterally extending foot member 56) should be considered because minimization of translation in the industry is desirable.

Orbital displacement of the first and second orbital pivot points A, C may be achieved as follows. As shown in FIG. 3, the laterally extending member 57 extending between the upper portions of the opposing laterally spaced links 55 may be provided with a yoke 70. It should be noted that the angle of the links 55 relative to the yoke 70 may be dependent of the actuator 94, described in greater details below, and the actuator stroke. The yoke 70 is adapted to pivotally receive a first end of an actuator rod 82. The first end of the actuator rod 82 is pivotally displaceable relative to the yoke 70 about a pivot axis E extending through the yoke 70. The actuator rod 82 is longitudinally displaceable to pivot the laterally extending member 57 about point B, which in turn moves the laterally spaced links 55. Movement of the laterally spaced links 55 causes the bent leg members 54 to move downward, which in turn causes the orbital pivot points A, C to move along an orbital path relative to the line L-L in FIG. 4 by virtue of the connection between the bent leg members 54 and the stabilizer 18. This causes the bed to raise or lower the bed 10. It should be noted that, to make use of the full swing of the yoke 70, the yoke 70 is preferably oriented so as to be extending substantially vertically below the laterally extending member 57 (i.e., bottom dead center of the laterally extending member 57) when the main frame 14 is positioned halfway between its lower position and raised position. At this juncture, the yoke 70 may be vertically situated between the upper laterally extending member 57 and the lower laterally extending foot member 56 supporting the wheels 58, 58'.

During operation of the legs 16, it can be seen that pivotal movement of the laterally extending member 57 in a direction of arrow O about the movable upper pivot point B has the effect of rotating the links 55 in a downward direction while the stabilizers 18 urge the legs 16 downward in the direction of arrow P about the first orbital pivot point A divergent from the links 55. This causes the legs 16 to extend in a downward position, as shown in FIG. 4. In contrast, movement of the laterally extending member 57 in a direction opposite to that of arrow O has the effect of rotating the links 55 in an upward direction while the stabilizers 18 pull the legs 16 upward in a direction opposite to that of arrow P about the first orbital pivot point A, convergent toward the links 55. This has the effect of rotating the legs in an upward direction to retract the legs 16 upward, as indicated in FIG. 2. As can be seen in reference to FIGS. 2, 3 and 4, if the laterally extending member 57 is not rotated, then the links 55 do not move, and the legs are maintained in their current position. This allows the legs 16 to remain stable and maintain the position of the main frame 14 relative to the support surface in the lower position, in the raised position, and in any position between the lower position and the raised position.

As shown in FIG. 1, the actuator rod 82 may be supported for pivotal movement relative to a pivot plate 90. The pivot plate 90 is supported for rotation relative to the main frame 14 via a first or main pivot point, indicated at F. The pivot plate 90 is supported for rotation in a plane that is substantially horizontal, or substantially parallel to the main frame 14 or the supporting surface. The first pivot point F is supported along a pivot axis that is substantially vertical, or substantially perpendicular to the main frame 14 or the supporting surface. In the illustrated embodiment of the invention, a pair of actuator rods 82 is supported for pivotal movement relative to a pivot plate 90, each at a second pivot point, indicated at G. Due to the symmetry of the illustrated embodiment, these pivot points G are oppositely disposed relative to the first pivot point F, and are spaced equidistantly apart from the main pivot point F. Each actuator rod 82 extends from the pivot plate 90 to the yoke 70 of a corresponding link assembly 59 for driving the legs 16 at the head and foot ends 26, 28 of the main frame 14. The pivot plate 90 may be driven for rotation by an actuator 94, such as the linear actuator shown. The actuator 94 may be supported for pivotal movement at a first end 96 relative to the pivot plate 90 at a third pivot point, designated at H. A second end 100 of the actuator 94 may be pivotally displaceable relative to the main frame 14 at a fourth pivot point, designated at I. Movement of the actuator 94 along the lines M-M rotates the pivot plate 90 about the first pivot point F to simultaneously drive each of the actuator rods 82. The actuator rods 82 simultaneously drive the link assemblies 59, which drive the legs 16. It should be appreciated that the pivot plate 90 may function as a lever arm so that the actuator 94 may provide a greater mechanical advantage and/or increase the speed of the mechanism, depending on the relative positions of pivot points F, H.

Figure 5:
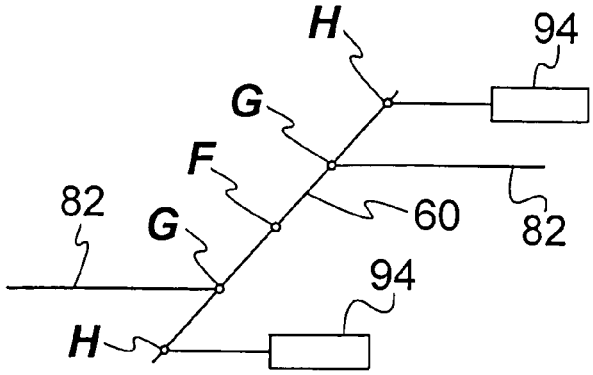
FIG. 5 is a diagrammatic representation of a mechanism for the high/low bed having multiple actuators.
Figure 6:
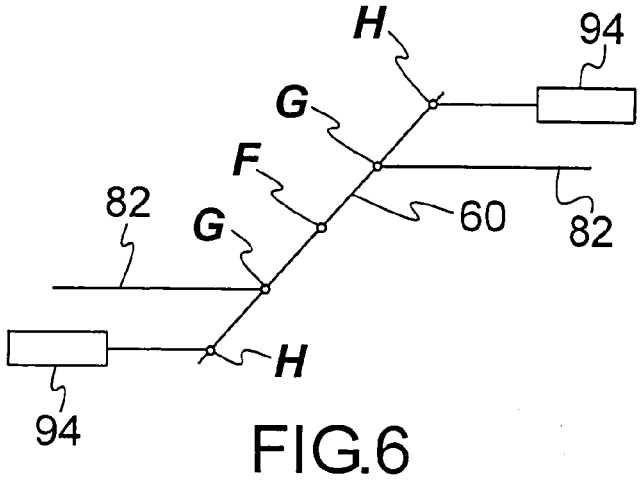
FIG. 6 is a diagrammatic representation of another mechanism having multiple actuators.
Figure 7:
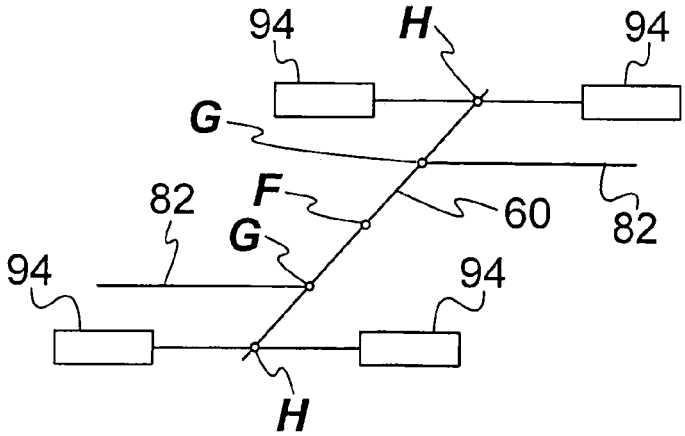
FIG. 7 is a diagrammatic representation of yet another mechanism for the high/low bed having multiple actuators.
Figure 8:
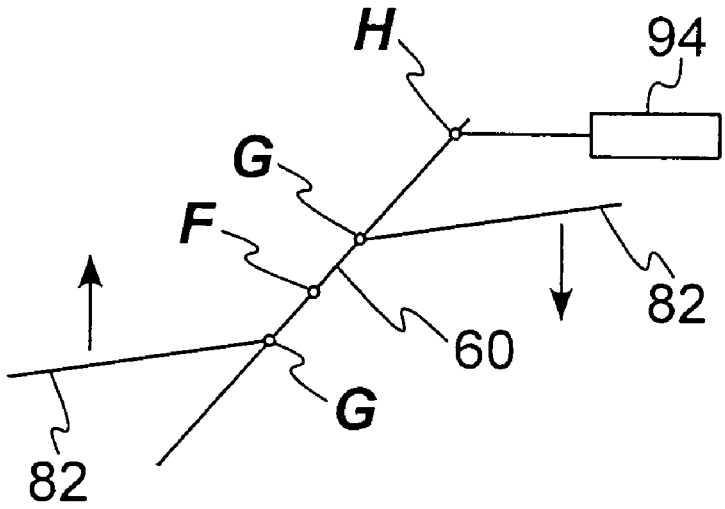
FIG. 8 is a diagrammatic representation showing effects of locations of actuator rod connection points relative to actuator force requirements.
Figure 9:
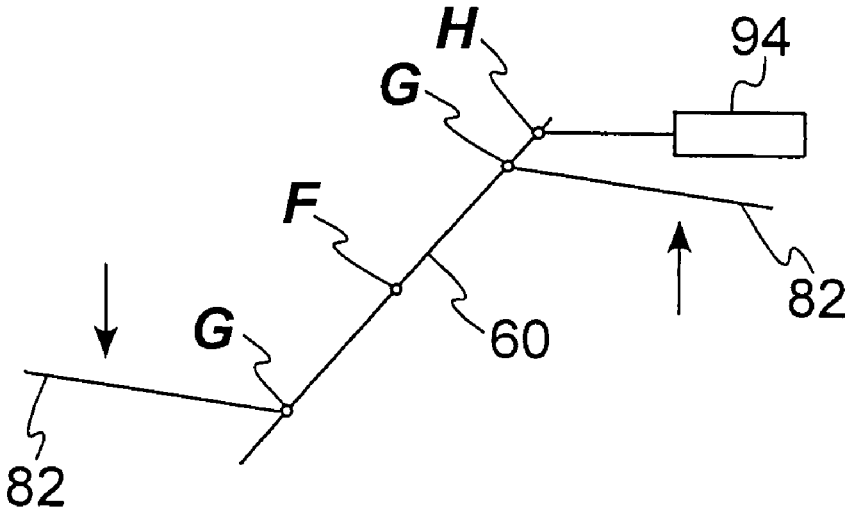
FIG. 9 is a diagrammatic representation further showing effects of locations of actuator rod connection points relative to actuator force requirements.

Although not shown, it should be appreciated that one or more other actuators may be connected to the pivot plate 90, together with the actuator 94, for rotating the pivot plate 90. For example, another actuator 94 may be connected to the pivot plate 90 and may pull the pivot plate 90 as the first actuator 94 pushes the pivot plate 90, and vice versa, as diagrammatically illustrated in FIG. 5. As yet another alternative, an actuator 94 may be connected to the pivot plate 90 and may push the pivot plate 90 as the first actuator 94 pushes the pivot plate 90, as diagrammatically illustrated in FIG. 6. As still another alternative, actuators 94 may be connected to the pivot plate 90 to both push and pull the pivot plate 90 simultaneously, as diagrammatically illustrated in FIG. 7. It should be appreciated that the locations of the second pivot points G may affect the amount of force required by the actuator 94 and the translation (i.e., longitudinal travel of the lower laterally extending foot member 56). For example, by moving the second pivot points G outward and away from the first pivot F, as shown in FIG. 9, the amount of force required by the actuator 94 may increase but translation may decrease. Conversely, by moving the second pivot points G inward and toward the first pivot F, as shown in FIG. 8, the amount of force required by the actuator 94 may decrease but translation may increase.

In the illustrated embodiment of the invention, it should be noted that the actuator rods 82 are not perpendicular relative to the pivot plate 90. A perpendicular approach to the pivot plate 90 may require more force from the actuator 94 to rotate the pivot plate to in turn drive the actuator rods 82 and displace the legs 16, although this may be dependent on other factors, such as the use of other actuator rods 82 or legs 16. In the illustrated embodiment of the invention, the actuator 94 approaches the pivot plate at an angle of about 30 degrees, although other angles may be suitable for carrying out the invention.

It should be noted that the pivot plate 90 rotates substantially parallel to the main frame 14 and the supporting surface and thus allows a low profile mechanism for use in a hi/low bed. Tie rod ends or rod eyes (i.e., on the ends of the actuator rods 82) may allow at least two degrees of freedom, which may be desirable for operation of the bed 10. It should also be noted that the pivot plate 90 functions as a lever arm to provide additional leverage from the actuator 94, which in turn may provide adequate force to lift the bed 10 with loads commensurate with industry standards, where conventional beds may fail. This is particularly advantageous in instances where adequate force to lift the bed is provided with a fixed amount of thrust from a DC actuator in a compact form.

Figure 11:
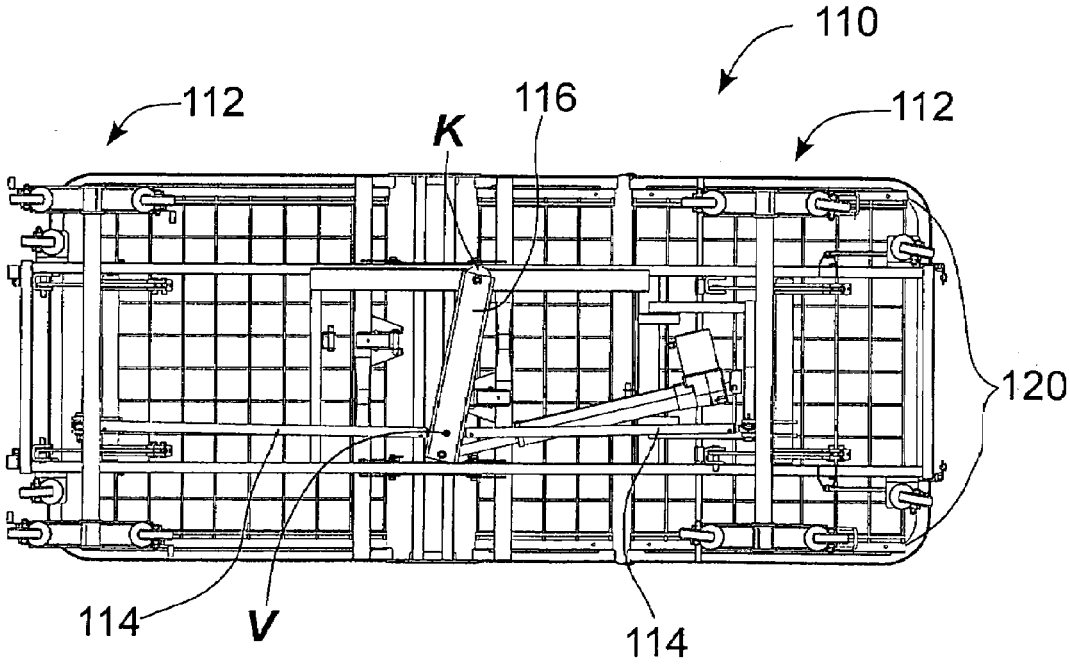
FIG. 11 is a bottom perspective view of the high/low bed as shown in FIG. 10.

It should be appreciated that the legs 16 and the stabilizers 18 shown and described above are provided for illustrative purposes and that the invention may practiced with other legs 16 and the stabilizers 18. For example, in FIGS. 10 and 11 there is illustrated a high/low bed 110, which may have legs 112 similar to the bed 10 described above. However, unlike the bed 10 described above, which has legs 18 that move in diverging and converging directions, the legs 112 of the bed 110 shown in FIGS. 10 and 11 move in like directions. It should be noted that the legs 112 are simultaneously driven by actuating rods 114, like the bed 10 above, but the actuating rods move in the same direction, not in opposite directions, like the bed 10 described above. Accordingly, the actuating rods 114 are supported for pivotal movement relative to a pivot plate 116, each at a second pivot point indicated at V, on a like side of a first or main pivot point K, unlike the bed 10 described above wherein the corresponding pivot points G are oppositely disposed relative to the first pivot point F. Although the second pivot points J are substantially coincident and thus spaced substantially equidistantly apart from the first pivot point K, the invention may be practiced in another suitable manner. Additionally, the actuating rods 114 need not be the same length but may be of different lengths, as shown in the drawings. Additionally, the bed 110 need not have pentagonal shaped wheels 58', like the bed 10 described above, but instead may be provide with a wheel and brake assembly 120 comprising one or more conventional wheels the movement of which is resisted or prevented by a brake that is activated by a brake lever, as shown in FIG. 10.

Also, it should be appreciated that the pivot plate shown and described above is provided for illustrative purposes and that the invention may be used with linkages other than that shown and described above. Moreover, actuators may be connected directly or indirectly to the legs 16, without a linkage.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A bed comprising:

a main frame;

a link pivotally attached at an upper end to the main frame;

a leg member pivotally attached at an upper end to a lower end of the link; and a stabilizer pivotally attached at an upper end to the main frame and pivotally attached at a lower end to the leg member;

wherein the link, leg member and stabilizer are configured to move the main frame between a lower position and a raised position relative to a support surface, wherein the link and stabilizer maintain a non-parallel relationship in the lower position, in the raised position, and as the main frame is moved between the lower position and the raised position; and wherein the leg members are configured to support the position of the main frame relative to the support surface in the lower position, in the raised position, and in any position between the lower position and the raised position.

2. The bed of claim 1, wherein the main frame extends in a longitudinal direction and wherein the leg member comprises an upper portion and a lower portion, separated by a bend in the longitudinal direction.

3. The bed of claim 2, wherein the stabilizer is pivotally attached to the upper portion of the leg member.

4. A bed comprising:

a main frame having a longitudinal direction;

a leg at a head end of the bed and a leg at a foot end of the bed, each leg comprising:

a link pivotally attached at an upper end to the main frame, a leg member pivotally attached at an upper end to a lower end of the link, a foot member attached to a lower end of the leg member and configured for contact with a support surface, and a stabilizer pivotally attached at an upper end to the main frame and pivotally attached at a lower end to the leg member;

wherein the legs are configured to move the main frame between a lower position and a raised position relative to the support surface, wherein the link and stabilizer maintain a non-parallel relationship in the lower position, in the raised position, and as the main frame is moved between the lower position and the raised position, and wherein the legs are further configured such that the spacing between the foot member at the head end of the bed and the foot member at the foot end of the bed is substantially the same when the main frame is in the lower position and when the main frame is in the raised position.

5. The bed of claim 4, wherein the legs are configured to maintain the position of the main frame relative to the support surface in the lower position, in the raised position, and in any position between the lower position and the raised position.

6. The bed of claim 4, wherein the legs are further configured such that the longitudinal position of the foot member relative to the main frame is substantially the same when the main frame is in the lower position and when the main frame is in the raised position.

7. The bed of claim 6, wherein the legs are configured to maintain the position of the main frame relative to the support surface in the lower position, in the raised position, and in any position between the lower position and the raised position.

8. A bed comprising:

a main frame having a longitudinal direction;

a leg comprising a link pivotally attached at an upper end to the main frame, a leg member pivotally attached at an upper end to a lower end of the link, a foot member attached to a lower end of the leg member and configured for contact with a support surface, and a stabilizer pivotally attached at an upper end to the main frame and pivotally attached at a lower end to the leg member;

wherein the leg is configured to move the main frame between a lower position and a raised position relative to the support surface, wherein the link and stabilizer maintain a non-parallel relationship in the lower position, in the raised position, and as the main frame is moved between the lower position and the raised position, and wherein the leg is further configured such that the longitudinal position of the foot member relative to the main frame is substantially the same when the main frame is in the lower position and when the main frame is in the raised position.

9. The bed of claim 8, wherein the leg is configured to maintain the position of the main frame relative to the support surface in the lower position, in the raised position, and in any position between the lower position and the raised position.

10. The bed of claim 8, wherein the leg is located at a head end of the bed, further comprising a leg located at a foot end of the bed, wherein the legs are configured such that the spacing between the foot member at the head end of the bed and the foot member at the foot end of the bed is substantially the same when the main frame is in the lower position and when the main frame is in the raised position.

11. The bed of claim 10, wherein the legs are configured to maintain the position of the main frame relative to the support surface in the lower position, in the raised position, and in any position between the lower position and the raised position.

* * * * *